United States Patent [19]

Das et al.

[11] Patent Number: 4,765,954

[45] Date of Patent: Aug. 23, 1988

[54] RAPIDLY SOLIDIFIED HIGH STRENGTH, CORROSION RESISTANT MAGNESIUM BASE METAL ALLOYS

[75] Inventors: Santosh K. Das, Randolph; Chin-Fong Chang, Lake Hiawatha, both of N.J.

[73] Assignee: Allied Corporation, Morris Township, Morris County, N.J.

[21] Appl. No.: 781,620

[22] Filed: Sep. 30, 1985

[51] Int. Cl.[4] ..... C22C 23/02; C22C 1/04

[52] U.S. Cl. ..... 420/403; 75/249; 148/11.5 M; 148/11.5 P; 148/420; 419/23; 419/33; 419/48; 419/68; 420/405; 420/408; 420/409; 420/410; 428/606

[58] Field of Search ..... 420/407, 408, 409, 411, 420/412, 405, 403; 148/11.5 P, 11.5 M, 126.1, 403, 406, 420; 75/229, 249, 251, 255; 164/460, 463, 476; 419/23, 29, 33, 48, 68; 428/606

[56] References Cited

U.S. PATENT DOCUMENTS

| | | | |
|---|---|---|---|
| 2,659,133 | 11/1953 | Leontis et al. | 420/407 |
| 4,347,076 | 8/1982 | Ray et al. | 148/11.5 P |
| 4,395,464 | 7/1983 | Panchanathan et al. | 419/48 |
| 4,404,028 | 9/1983 | Panchanathan et al. | 419/48 |
| 4,473,402 | 9/1984 | Ray et al. | 148/403 |

*Primary Examiner*—L. Dewayne Rutledge
*Assistant Examiner*—Robert L. McDowell
*Attorney, Agent, or Firm*—Ernest D. Buff; Gerhard H. Fuchs

[57] ABSTRACT

A rapidly solidified magnesium based alloy contains finely dispersed magnesium intermetallic phases. The alloy has the form of a filament or a powder and is especially suited for consolidation into bulk shapes having superior combination of strength, ductility and corrosion resistance.

15 Claims, 3 Drawing Sheets

RAPIDLY SOLIDIFIED HIGH STRENGTH, CORROSION RESISTANT MAGNESIUM BASE METAL ALLOYS

DESCRIPTION

1. Field of Invention

This invention relates to high strength, corrosion resistant magnesium based metal alloys, and more particularly to ribbon and powder products made by rapid solidification of the alloys and to bulk articles made by consolidation of the powder.

2. Description of the Prior Art

Although magnesium has reasonable corrosion properties under regular atmospheric conditions, it is susceptible to attack by chloride containing environments. This poor corrosion resistance of magnesium has been a serious limitation against wide scale use of magnesium alloys. It is well documented [J. D. Hanawalt, C. E. Nelson, and J. A. Peloubet, "Corrosion Studies of Magnesium and its Alloys," *Trans AIME,* 147 (1942) pp. 273–99] that heavy metal impurities such as Fe, Ni, Co and Cu have a profound accelerating effect on the salt water corrosion rate. Recently attempts have been made to improve the corrosion resistance of magnesium alloys by reducing the impurity levels and high purity alloys such as AZ91HP have been introduced in the market place. However, the mechanical strength of this alloy is rather low.

It is known that rapid solidification processing (RSP) effects microstructural refinements in many alloy systems, which provide such systems with distinct advantages. The high cooling rates ($\sim 10^5$–$10^7$ $\mu$C/sec) obtained with RSP can produce extended solid solubility, metastable phases, fine intermetallic dispersoids and reduce compositional segregation, all of which contribute to improved mechanical properties (see Proceedings of International Conference on Rapid Solidification Processing II eds. R. Mehrabian, B. H. Kear and M. Cohen, Claitors Publishing Division, Baton Rouge, La. 1980). This has been demonstrated for nickel, iron and aluminum based alloys (U.S. Pat. No. 4,347,076) and more recently for titanium-based alloys (Journal of Metals, September 1983, p. 21). However, RSP has not been widely used to improve corrosion resistance and mechanical properties of magnesium base alloys.

Almost all of the studies on rapidly solidified magnesium alloys to date have been on either commercial alloys or simple binary alloys. For example, Calka et al. [A. Calka, M. Madhava, D. E. Polk, B. C. Giessen, H. Matyja and J. Vander Sande, "A Transition-Metal-Free Amorphous Alloy: $Mg_{70}Zn_{30}$, " *Scripta Metall.*, 11 (1977), pp. 65–70.] studied amorphous alloys of the composition $Mg_{70}Zn_{30}$ made by melt spinning. Microcrystalline $Mg_{100-x}Zn_x$ alloys with $x=26$–$32$ atom percent have been produced by crystallization of amorphous splats prepared by a gun technique [P. G. Boswell, "Crystallization of an $Mg_{74}Zn_{26}$ Glass," *Mat. Science and Engg.,* 34 (1978) pp. 1–5]. More recently, Masur et al. [L. J. Masur, J. T. Burke, T. Z. Kattamis, and M. C. Flemings, "Microsegregation of an Aluminum and Magnesium Alloy at High Solidification Rates," pp. 185–189 in *Rapidly Solidified Amorphous and Crystalline Alloys,* B. H. Kear, B. C. Giessen and M. Cohen eds., Elsevier Science Publishing Co., 1982.] studied microstructure of microcrystalline magnesium alloy ribbons containing 1.7 to 2.3 atom percent Zn made by melt spinning. The homogeneous solid solution range of such ribbon was found to be limited to a chill zone (the ribbon surface next to the quenching substrate) of 10 to 20 $\mu$m wide, beyond which a two phase region was observed. In all of the aforementioned studies, no attempt has been made to determine the mechanical properties of either the amorphous or microcrystalline alloys. The recent study by Isserow et al. [S. Isserow and F. J. Rizzitano, "Microquenched Magnesium ZK60A Alloy," *Inten'l. J. of Powder Metallurgy and Powder Technology,* 10(3) (1974), pp. 217–227.] included the mechanical properties of consolidated bodies prepared from rapidly solidified commercial ZK60A powder. However, Isserow and Rizzitano, used the rotating electrode process to make powders of commercial alloy ZK60A (Mg—6 wt % Zn—0.45 wt % Zr) and the average particle size obtained using the rotating electrode process is about 100 $\mu$m and the cooling rate for such particles is $<10^4$ K/s [N. J. Grant, "Rapid Solidification of Metallic Particulates," *Journal of Metals,* 35(1) (1983), pp. 20–27].

Consolidated bodies can be produced from powder/particulate by using conventional powder metallurgy techniques. Work on consolidation of rapidly solidified magnesium powders is relatively rare. Busk and Leontis [R. S. Busk and T. I. Leontis, "The Extrusion of Powdered Magnesium Alloys," *Trans. AIME.* 188(2) (1950), pp. 297–306.] investigated hot extrusion of atomized powder of a number of commercial magnesium alloys in the temperature range of 316° C. (600° F.)–427° C. (800° F.). The as-extruded properties of alloys extruded from powder were not significantly different from the properties of extrusions from permanent mold billets. In the study reported by Isserow and Rizzitano, discussed earlier, on commercial ZK60A magnesium alloy powder made by a rotating electrode process extrusion temperatures varying from ambient to 371° C. (700° F.) were used. The mechanical properties of the room temperature extrusions were significantly better than those obtained by Busk and Leontis but those extruded at 121° C. (250° F.) did not show any significant difference between the conventionally processed and rapidly solidified material. However, care must be exercised in comparing their mechanical properties in the longitudinal direction from room temperature extrusions since they observed significant delamination on the fracture surfaces; and properties may be highly inferior in the transverse direction. In all the studies reported to date no effort was made to investigate the effect of alloy chemistry, so as to take advantage of the microstructural refinement obtained during rapid solidification processing.

There remains a need in the art for rapidly solidified magnesium alloys containing uniform dispersions of intermetallic compounds that provide the alloys with good corrosion resistance combined with high strength and ductility.

SUMMARY OF THE INVENTION

The present invention provides a high strength, corrosion resistant magnesium based alloy which can be formed into ribbon or powder and which is especially suited for consolidation into bulk shapes having a fine microstructure. Generally stated, the alloy has a composition consisting essentially of the formula $Mg_{bal}Al_aZn_bX_c$, wherein X is at least one element selected from the group consisting of manganese, cerium, neodymium, praseodymium, yttrium and silver, "a" ranges from about 0 to 15 atom percent, "b" ranges from about 0 to 4 atom percent, "c" ranges from about 0.2 to 3 atom percent, the balance being magnesium and incidental impurities, with the proviso that the sum of aluminum and zinc present ranges from about 2 to 15 atom percent.

The invention also provides a method wherein the magnesium alloys of present invention are subjected to rapid solidification processing by using a melt spin casting method wherein the liquid alloy is cooled at a rate of $10^5$ to $10^7$° C./sec while being formed into a solid ribbon or sheet. That process further comprises the provision of a means to protect the melt puddle from burning, excessive oxidation and physical disturbance by the air boundary layer carried with the moving substrate. Said protection is provided by a shrouding apparatus which serves the dual purpose of containing a protective gas such as a mixture of air or $CO_2$ and $SF_6$, a reducing gas such as CO or an inert gas, around the nozzle while excluding extraneous wind currents which may disturb the melt puddle.

The alloying elements manganese, cerium, neodymium, paraseodymium, yttrium and silver, upon rapid solidification processing, form a fine uniform dispersion of intermetallic phases such as $Mg_3Ce$,$Mg_3Nd$,$Mg_3Pr$,$Mg_{17}Y_3$, depending on the alloy composition. These finely dispersed intermetallic phases increase the strength of the alloy and help to maintain a fine grain size by pinning the grain boundaries during consolidation of the powder at elevated temperature. The addition of the alloying elements aluminum and zinc contributes to strength via matrix solid solution strengthening and by formation of certain age hardening precipitates such as $Mgl_7Al_2$ and MgZn.

This invention also provides a method of forming consolidated metal alloy article. The method includes the step of compacting powder particles of the magnesium based alloy of the invention. The particles can be cold pressed, or warm pressed by heating in a vacuum to a pressing temperature ranging from 150° C. to 300° C., which minimizes coarsening of the dispersed, intermetallic phases. The powder particles can also be consolidated into bulk shapes using conventional methods such as extrusion, forging and superplastic forming.

Additionally, the invention provides a consolidated metal article made from magnesium based alloys of the invention. The consolidated article exhibits good corrosion resistance (ie. corrosion rate of less than 50 mils per year when immersed in a 3 percent NaCl aqueous solution at 25° C. for 96 hours) together with high ultimate tensile strength (up to 513 MPa (74.4 ksi)) and good (i.e. 5 percent tensile elongation) ductility at room temperature, which properties are, in combination, far superior to those of conventional magnesium alloys. The articles are suitable for applications as structural members in helicopters, missiles and air frames where good corrosion resistance in combination with high strength and ductility is important.

BRIEF DESCRIPTION OF THE DRAWINGS

The invention will be more fully understood and further advantages will become apparent when reference is made to the following detailed description and the accompanying drawings, in which:

FIG 1(*b*) is a transmission electron micrograph of as-cast ribbon of the alloy $Mg_{91}Zn_2Al_5Y_2$ alloy;

FIG. 2(*b*) is a transmission electron micrograph of as-extruded bulk compact of alloy $Mg_{91}Zn_2Al_5Y_2$ illustrating fine grain size and dispersoid retained after compaction.

DETAILED DESCRIPTION OF THE INVENTION AND THE PREFERRED EMBODIMENTS

In accordance with the present invention nominally pure magnesium is alloyed with about 0 to 15 atom percent aluminum, about 0 to 4 atom percent zinc, about 0.2 to 3 atom percent of at least one element selected from the group consisting of manganese, cerium, neodymium, praseodymium, yttrium and silver the balance being magnesium and incidental impurities, with the proviso that the sum of aluminum and zinc present ranges from about 2 to 15 atom percent. The alloys are melted in a protective environment; and quenched in a protective environment at a rate of at least about $10^5$° C./sec by directing the melt into contact with a rapidly moving chilled surface to form thereby a rapidly solidified ribbon. Such alloy ribbons have high strength and high hardness (i.e. microVickers hardness of at least about 125 kg/mm$^2$). When aluminum is alloyed without addition of zinc, the minimum aluminum content is preferably above about 6 atom percent.

The alloys of the invention have a very fine microstructure which is not resolved by optical microscopy. Transmission electron microscopy reveals a substantially uniform cellular network of solid solution phase ranging from 0.2–1.0 μm in size, together with precipitates of very fine, binary or ternary intermetallic phases which are less than 0.5 μm and composed of magnesium and other elements added in accordance with the invention.

Figure 1A:
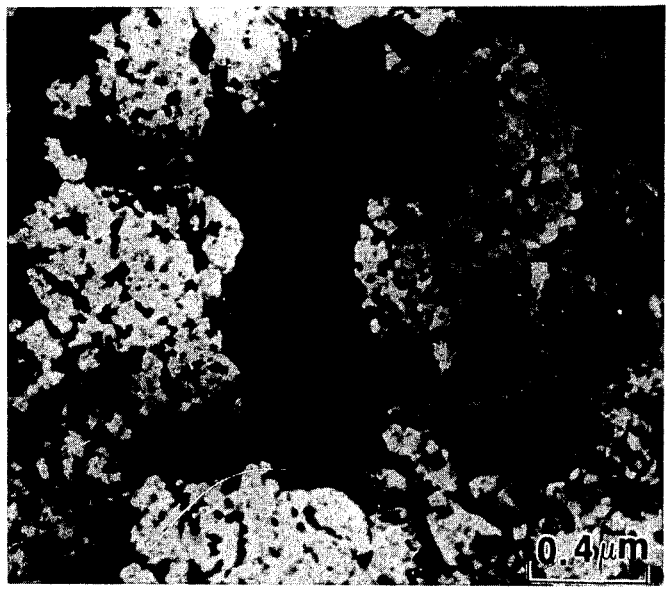
FIG. 1(*a*) is a transmission electron micrograph of as-cast ribbon of the alloy $Mg_{92}Zn_2Al_5Ce_1$ illustrating the fine grain size and precipitates thereof.
Figure 1B:
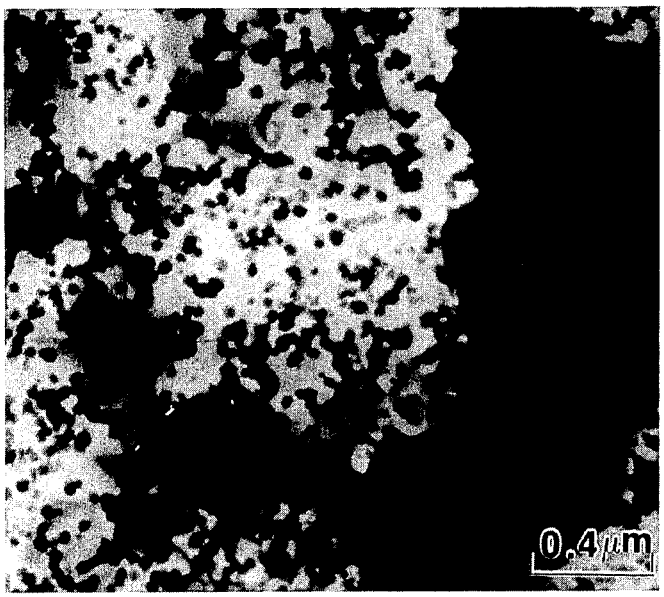

In FIGS. 1(*a*) and 1(*b*) there are illustrated the microstructures of ribbon cast from alloys consisting essentially of the compositions $Mg_{92}Zn_2Al_5Ce_1$ and $Mg_{91}Zn_2Al_5Y_2$, respectively. The microstructures shown are typical of samples solidified at cooling rate in excess of $10^5$° C./sec and is responsible for high hardness ranging from 140–200 kg/mm$^2$. The high hardness of Mg-Al-Zn-X alloys can be understood by the fine microstructure observed in as-cast ribbons. The as-cast microstructure of alloys containing Ce, Pr and Nd are very similar and show a cellular microstructure with precipitation of $Mg_3X$ (X=Ce, Nd, Pr) both inside the cell and at cell boundaries (FIG. 1*a*). The alloy containing Y shows fine spherical precipitates of $Mg_{17}Y_3$ dispersed uniformly throughout (FIG. 1*b*).

The as cast ribbon or sheet is typically 25 to 100 μm thick. The rapidly solidified materials of the above described compositions are sufficiently brittle to permit them to be mechanically comminuted by conventional apparatus, such as a ball mill, knife mill, hammer mill, pulverizer, fluid energy mill, or the like. Depending on the degree of pulverization to which the ribbons are subjected, different particle sizes are obtained. Usually the powder comprises of platelets having an average thickness of less than 100 μm. These platelets are characterized by irregular shapes resulting from fracture of the ribbon during comminution.

The powder can be consolidated into fully dense bulk parts by known techniques such as hot isostatic pressing, hot rolling, hot extrusion, hot forging, cold pressing followed by sintering, etc. The microstructure obtained after consolidation depends upon the composition of the alloy and the consolidation conditions. Excessive times at high temperatures can cause the fine precipitates to coarsen beyond the optimal submicron size, leading to a deterioration of the properties, i.e. a decrease in hardness and strength.

Figure 2A:
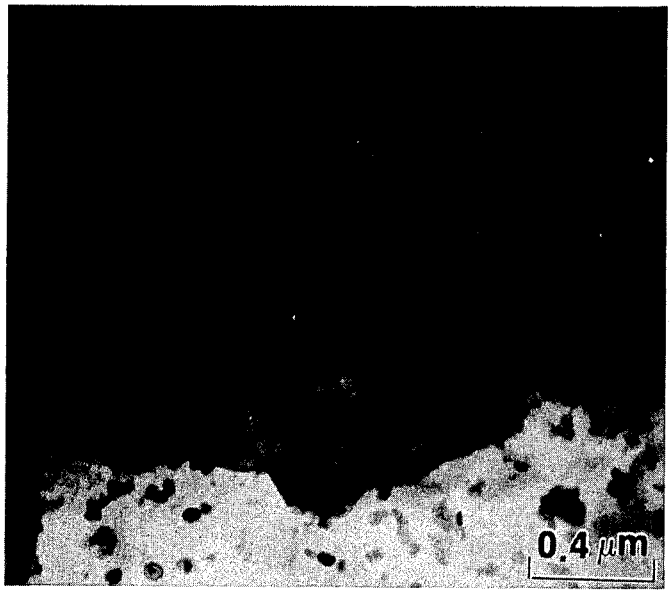
FIG. 2(*a*) is a transmission electron micrograph of as-extruded bulk compact of alloy $Mg_{92}Zn_2Al_5Ce_1$.
Figure 2B:
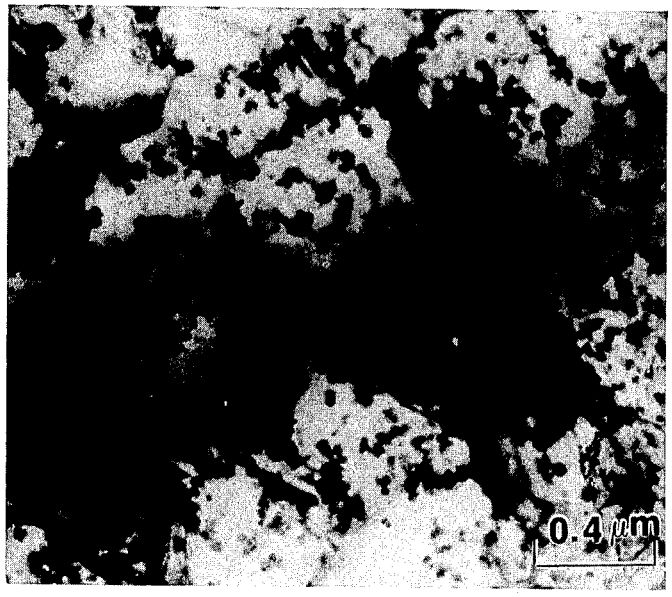

As representatively shown in FIGS. 2(*a*) and 2(*b*) for alloys $Mg_{92}Zn_2Al_5Ce_1$ and $Mg_{91}Zn_2Al_5Y_2$, respectively, the compacted consolidated article of the invention is composed of a magnesium solid solution phase having an average grain size of 0.5 μm, containing a substantially uniform distribution of dispersed intermetallic phase $Mg_3X$ (X=Ce, Nd, Pr) or $Mg_{17}Y_3$ depending on the alloy and in addition, the microstructure contains aluminum containing precipitates of phase $Mg_{17}Al_{12}$ and zinc containing phase MgZn. Both $Mg_{17}Al_{12}$ and MgZn phases are usually larger than the $Mg_3X$ phase and is 0.5 to 1.0 μm in size depending on the consolidation temperature.

At room temperature (about 20° C.), the compacted, consolidated article of the invention has a Rockwell B hardness of at least about 55 and is more typically higher than 65. Additionally, the ultimate tensile strength of the consolidated article of the invention is at least about 378 MPa(55 ksi).

The following examples are presented in order to provide a more complete understanding of the invention. The specific techniques, conditions, materials and reported data set forth to illustrate the invention are exemplary and should not be construed as limiting the scope of the invention.

EXAMPLE I

Ribbons samples were cast in accordance with the procedure described above by using an over pressure of argon or helium to force molten magnesium alloy through the nozzle onto a water cooled copper alloy wheel rotated to produce surface speeds of between about 900 m/min and 1500 m/min. Ribbons were 0.5–2.5 cm wide and varied from about 25 to 100 μm thick.

The nominal compositions of the alloys based on the charge weight added to the melt are summarized in Table 1 together with their as-cast hardness values. The hardness values are measured on the ribbon surface which is facing the chilled substrate; this surface being usually smoother than the other surface. The microhardness of these Mg-Al-Zn-X alloys of the present invention ranges from 140 to 200 Kg/mm$^2$. The as-cast hardness increases as the rare earth content increases. The hardening effect of the various rare earth elements on Mg-Zn-Al-X alloys is comparable. For comparison, also listed in Table 1 is the hardness of a commercial corrosion resistant high purity magnesium AZ91C-HP alloy. It can be seen that the hardness of the present invention is higher than commercial AZ91C-HP alloy.

TABLE 1

Microhardness (Kg/mm$^2$) Values of R.S. Mg—Al—Zn—X As Cast Ribbons.

| Sample | Alloy Nominal (At %) | Hardness |
|---|---|---|
| 1 | $Mg_{92.5}Zn_2Al_5Ce_{0.5}$ | 151 |
| 2 | $Mg_{92}Zn_2Al_5Ce_1$ | 186 |
| 3 | $Mg_{92.5}Zn_2Al_5Pr_{0.5}$ | 150 |
| 4 | $Mg_{91}Zn_2Al_5Y_2$ | 201 |
| 5 | $Mg_{88}Al_{11}Mn_1$ | 162 |
| 6 | $Mg_{88.5}Al_{11}Nd_{0.5}$ | 140 |
| Commercial Alloy AZ 91C-HP | | |
| 7 | $(Mg_{91.7}Al_{8.0}Zn_{0.2}Mn_{0.1})$ | 116 |
| (alloy outside the present invention) | | |

EXAMPLE II

The rapidly solidified ribbons of the present invention were subjected first to knife milling and then to hammer milling to produce −60 mesh powders. The powders were vacuum outgassed and hot pressed at 200° C.–220° C. The compacts were extruded at temperatures of about 200°–250° C. at extrusion ratios ranging from 14:1 to 22:1. The compacts were soaked at the extrusion temperature for about 2–4 hrs. Tensile samples were machined from the extruded bulk compacted bars and tensile properties were measured in uniaxial tension at a strain rate of about $10^{-4}$/sec at room temperature. The tensile properties together with Rockwell B ($R_B$) hardness measured at room temperature are summarized in Table 2. The alloys of the present invention show high hardness ranging from 65 to about 81 $R_B$.

Most commercial magnesium alloys have a hardness of about 50 $R_B$. The density of the bulk compacted samples measured by conventional Archimedes technique is also listed in Table 2.

Both the yield strength and ultimate tensile strength (UTS) of the present invention are exceptionally high. For example, the alloy $Mg91Zn_2Al_5Y_2$ has a yield strength of 66.2 Ksi and UTS of 74.4 Ksi which approaches the strength of some commercial low density aluminum-lithium alloys. The density of the magnesium alloys of the present invention is only 1.93 g/c.c. as compared with a density of 2.49 g/c.c. for some of the advanced low density aluminum lithium alloys now being considered for aerospace applications. Thus, on a specific strength (strength/density) basis the magnesium base alloys of the present invention provide a distinct advantage in aerospace applications. In some of the alloys ductility is quite good and suitable for engineering applications. For example, $Mg_{91}Zn_2Al_5Y_2$ has a yield strength of 66.2 Ksi, UTS of 74.4 Ksi, and elongation of 5.0%, which is superior to the commercial alloys ZK 60 A-T5, AZ 91 HP-T6, when combined strength and ductility is considered. The alloys of the present invention find use in military applications such as sabots for armor piercing devices, and air frames where high strength is required.

TABLE 2

Properties of Rapidly Solidified Mg—Al—Zn—X Alloy Extrusions

| Composition Nominal (AT %) | Density (g/c.c.) | Hardness ($R_B$) | Y.S. MPa(Ksi) | U.T.S. MPa(Ksi) | Elongation (%) |
|---|---|---|---|---|---|
| $Mg_{92.5}Zn_2Al_5Ce_{0.5}$ | 1.89 | 66 | 359 (52.1) | 425 (61.7) | 17.5 |
| $Mg_{92}Zn_2Al_5Ce_1$ | 1.93 | 77 | 425 (61.7) | 487 (70.6) | 10.1 |
| $Mg_{92.5}Zn_2Al_5Pr_{0.5}$ | 1.89 | 65 | 352 (51.1) | 427 (61.9) | 15.9 |

TABLE 2-continued

| Composition Nominal (AT %) | Density (g/c.c.) | Hardness ($R_B$) | Y.S. MPa(Ksi) | U.T.S. MPa(Ksi) | Elongation (%) |
|---|---|---|---|---|---|
| | Properties of Rapidly Solidified Mg—Al—Zn—X Alloy Extrusions | | | | |
| $Mg_{91}Zn_2Al_5Y_2$ | 1.93 | 81 | 456 (66.2) | 513 (74.4) | 5.0 |
| $Mg_{88}Al_{11}Mn_1$ | 1.81 | 66 | 373 (54.2) | 391 (56.8) | 3.5 |
| ALLOYS OUTSIDE THE SCOPE OF THE INVENTION | | | | | |
| Commercial Alloy | | | | | |
| ZK 60 A-T5 ($Mg_{97.7}Zn_{2.1}Zr_{0.2}$) | 1.83 | 50 | 303 (43.9) | 365 (52.9) | 11.0 |
| AZ 91 HP-T6 ($Mg_{91.7}Al_{8.0}Zn_{0.2}Mn_{0.1}$) | 1.83 | 50 | 131 (19.0) | 276 (40.0) | 5.0 |

EXAMPLE III

The as-cast ribbon and bulk extruded specimens of rapidly solidified Mg-Al-Zn-X alloys of the present invention were prepared for transmission election microscopy by combination of jet thinning and ion milling. Quantitative microstructural analysis of selected R.S. Mg-Al-Zn-X as-cast samples, as shown in Table 3, indicates that the fine grain size ranging from 0.36–0.70 μm and fine cell size ranging from 0.09–0.34 μm of magnesium grains have been obtained by rapid solidification process cited in the present invention. The fine dispersoid size of magnesium-rare earth intermetallic compounds ranging from 0.04–0.07 μm is also obtained. Because of high melting point and limited solid solubility, these fine dispersoids of magnesium-rare earth intermetallic compounds do not coarsen appreciably during high temperature consolidation and are quite effective in pinning the grain boundaries as illustrated in the micrographs in FIG. 2 and the quantitative results in Table 3 for as-extruded samples. Such fine grain and the dispersoid size lead to significant improvements in the mechanical properties as compared to conventionally processed material, as shown in Example 2.

TABLE 3

TEM Microstructure Analysis of Selected R.S. Mg—Al—Zn—X As-cast and Extruded Samples

| No. | Nominal Composition At (%) | Matrix Grain Size (μm) | Matrix Cell Size (μm) | Precipitate Size (μm) MgZn |
|---|---|---|---|---|
| 1 | $Mg_{92}Zn_2Al_5Ce_1$(a) | 0.56 | 0.14 | 0.07 |
| 2 | $Mg_{92}Zn_2Al_5Ce_1$(b) | 0.70 | — | 0.56 |
| 3 | $Mg_{92.5}Zn_2Al_5Pr_{0.5}$(a) | 0.70 | 0.34 | 0.15 |
| 4 | $Mg_{92.5}Zn_2Al_5Pr_{0.5}$(b) | 0.70 | — | 0.13 |
| 5 | $Mg_{91}Zn_2Al_5Y_2$(b) | 0.36 | — | 0.23 |

| No. | Precipitate Size (μm) $Mg_{17}Al_{12}$ | $Mg_3X$ (X = Nd, Ce,Pr) | $Mg_{17}Y_3$ | Volume Fraction (%) |
|---|---|---|---|---|
| 1 | — | 0.04 | — | — |
| 2 | 0.56 | 0.04 | — | 2.33 |
| 3 | 0.15 | 0.04 | — | — |
| 4 | 0.65 | 0.03 | — | 2.02 |
| 5 | 0.23 | — | 0.04 | 2.56 |

(a) As-Cast
(b) As-Extruded

Figure 3:
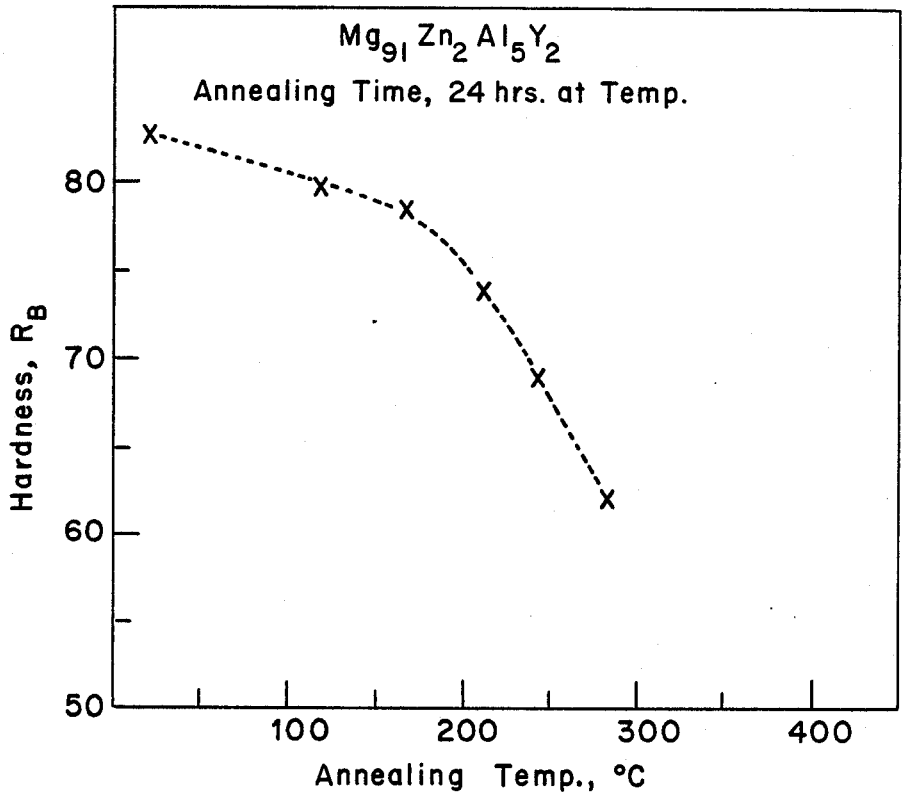
FIG. 3 is a plot of hardness of as-extruded alloy $Mg_{91}Zn_2Al_5Y_2$ as a function of annealing temperature, the hardness being measured at room temperature after annealing for 24 hrs. at the indicated temperature.

EXAMPLE IV The thermal stability of as-extruded Mg-Al-Zn-X alloys in the present invention, as indicated by the room temperature hardness measurement of the sample exposed at temperatures from ambient to 300° C. for 24 hours, is shown in FIG. 3. It can be seen that the addition of rare earth elements significantly improves the thermal stability of R.S. Mg-Al-Zn-X due to the superior stability of magnesium-rare earth intermetallic compounds such as $Mg_3X$ (X=Ce, Nd, Pr) and $Mg17Y_3$ over $Mg_{17}Al_{12}$ and MgZn phases. For example, $Mg_{91}Zn_2Al_5Y_2$ alloy still retains the hardness value of >60 $R_B$, after being exposed at temperatures up to 300° C. for 24 hours.

EXAMPLE V

A laboratory immersion corrosion test using a solution of 3% sodium chloride in water at 25° C. was conducted to compare the corrosion resistance of magnesium alloys relative to each other. The test conducted was the same as that recommended by ASTM standard G31-72. The apparatus consisted of a kettle (3000 ml size), a reflex condensor with atmospheric seal, a sparger for controlling atmosphere or aeration, a temperature regulating device, and a heating device. Samples were cut to a size of about 1.6 cm long and 1.0 cm in diameter, polished on a 600 grit sand paper and degreased by rinsing in acetone. The mass of the sample was weighed to an accuracy of ±0.0001 g. The dimension of each sample were measured to ±0.01 cm and the total surface area of each specimen was calculated.

After 96 hours immension, the specimens were taken out, rinsed with water and dried. The corrosion product on the specimen was removed by bristle brush. Acetone was used to degrease the specimen before weight measurement. The mass loss due to exposure and the average corrosion rate were calculated.

Table 4 compares the corrosion rate for an alloy of the present invention with two commercial alloys AZ 91HP-T6 and ZK 60A-T5. The corrosion rate of the alloy $Mg_{91}Al_5Zn_2Y_2$ of the present invention is less than that of either of the commercial alloys. Thus, rapidly solidified alloys of the present invention not only evidence improved mechanical properties, but also evidence improved corrosion resistance in salt water. The improvement in corrosion resistance may be due to the formation of the protective film on the surface of sample as the result of a reaction of the saline solution with the rare earth element, or the refined microstructure obtained through rapid solidification.

TABLE 4

Corrosion Behavior of Mg—Zn—Al—X Extrusions Exposed in 3% NaCl Aqueous Solution at 25° C. for 96 hrs.

| Nominal Composition (At %) | Corrosion Rate mil/year |
|---|---|
| $Mg_{91}Zn_2Al_5Y_2$ | 8 |
| ALLOYS OUTSIDE THE SCOPE OF THE INVENTION | |
| Commercial Alloys | |
| ZK 60 A-T5 ($Mg_{97.7}Zn_{2.1}Zr_{0.2}$) | 104 |
| AZ 91 HP-T6 ($Mg_{91.7}Al_{8.0}Zn_{0.2}Mn_{0.1}$) | 82 |

What is claimed is:

1. A rapidly solidified magnesium based alloy consisting essentially of the formula $Mg_{bal}Al_aZn_bX_c$, wherein X is at least one element selected from the group consisting of manganese, cerium, neodymium, praseodymium, yttrium and silver, "a" ranges from about 0 to 15 atom percent, "b" ranges from about 0 to 4 atom percent, "c" ranges from about 0.2 to 3 atom percent, the balance being magnesium and incidental impurities, with the proviso that the sum of aluminum and zinc present ranges from about 2 to 15 atom percent, said alloy having a microstructure comprised of a subtantially uniform cellular network of solid solution phase of a size ranging from 0.2–1.0 μm together with recipitates of magnesium containing intermetallic phases of a size less than 0.5 μm.

2. The alloy of claim 1 wherein said alloy having the form of a ribbon.

3. The alloy of claim 2 wherein said ribbon has a hardness of at least about 125 kg/mm$^2$ at room temperature.

4. An alloy as recited in claim 2, wherein said ribbon has a thickness ranging from about 25 to 100 μm.

5. An alloy as recited in claim 2, wherein said ribbon is a continuous strip.

6. The alloy of claim 1 wherein said alloy having the form of a powder.

7. An alloy as recited in claim 1 wherein said alloy, when immersed in a 3 perent NaCl aqueous solution at 25° C. for 96 hours, has a corrosion rate of less than 50 mils per year.

8. A method for making a magnesium containing alloy having a composition consisting essentially of the formula $Mg_{bal}Al_aZn_bX_c$, wherein X is at least one element selected from the group consisting of manganese, cerium, neodymium, paraseodymium, yttrium and silver, "a" ranges from about 0 to 15 atom percent, "b" ranges from about 0 to 4 atom percent, "c" ranges from about 0.2 to 3 atom percent, the balance being magnesium and incidental impurities, with the proviso that the sum of aluminum and zinc present ranges from about 2 to 15 atom percent, said method comprising the steps of:

(a) forming a melt of said alloy in a protective environment; and (b) quenching said melt in said protective environment at a rate of at least about $10^{5}$° C./sec by directing said melt into contact with a rapidly moving chilled surface to form thereby a rapidly solidified ribbon of said alloy, having a microstructure comprised of a substantially uniform cellular network of solid solution phase of a size ranging from 0.2–1.0 μm together with precipitates of magnesium containing intermetallic phases of a size less than 0.5 μm.

9. The method of claim 8 additionally comprising the step of comminuting said ribbon to form a powder.

10. A metal article consolidate from the powder of claim 9.

11. The method of claim 9 wherein said powder comprises platelets having an average thickness of less than 100 μm, said platelets being characterized by irregular shapes resulting from fracture of the ribbon during comminution.

12. The method of claim 11, further comprising the step of forming said powder into a consolidated body by the application thereto of pressure and heat.

13. The method of claim 11, further comprising the step of forming said powder into a consolidated body by the application thereto of pressure.

14. The method of claim 13 wherein said alloy has a microstructure and the consolidated body is heated to a temperature in the range of 150° C. to 300° C. for 24 hours, said microstructure having a fine grain size of about 0.36 to 0.70 μm with substantially uniform dispersion of ultrafine precipitates of intermetallic phases formed between magneium and one or more of said elements from the group X consisting of manganese, cerium, neodymium, paraseodymium yttrium and silver, said ultrafine precipitates having a characteristic size of less than about 0.5 μm.

15. A metal article consolidated as recited in claim 13, wherein said article is composed of magnesium solid solution phase containing a substantially uniform distribution of dispersed, intermetallic phase precipitates formed between magnesium and at least one element of the group X consisting of manganese, cerium, neodymium, paraseodymium, yttrium and silver, said precipitates having a characteristic size of less than about 0.5 μm.

* * * * *